United States Patent [19]

Schneider

[11] 4,077,200

[45] Mar. 7, 1978

[54] CASE FOR AN ELECTRONIC WRISTWATCH MODULE

[75] Inventor: Mark R. Schneider, San Jose, Calif.

[73] Assignee: Fairchild Camera and Instrument Corporation, Mountain View, Calif.

[21] Appl. No.: 716,611

[22] Filed: Aug. 23, 1976

[51] Int. Cl.[2] ..... G04B 19/34; G04C 3/00

[52] U.S. Cl. ..... 58/50 R; 58/23 R; 58/88 R; 200/61.43; 200/331; 200/DIG. 2

[58] Field of Search ..... 50/23 R, 50 R, 88 R; 200/61.43, 329, 330, 331, DIG. 2

[56] References Cited

U.S. PATENT DOCUMENTS

| | | | |
|---|---|---|---|
| 3,783,607 | 1/1974 | Feurer | 58/50 R X |
| 3,789,601 | 2/1974 | Bergey | 58/50 R |
| 3,800,525 | 4/1974 | Bergey | 58/50 R |
| 3,838,566 | 10/1974 | O'Connor et al. | 58/50 R |
| 3,952,176 | 4/1976 | Holder et al. | 58/23 R X |
| 3,961,472 | 6/1976 | Riehl | 58/50 R X |
| 3,974,351 | 8/1976 | Solov et al. | 58/23 R X |
| 3,991,552 | 11/1976 | Ho et al. | 58/50 R X |
| 3,991,554 | 11/1976 | Somogyi | 58/23 R X |

FOREIGN PATENT DOCUMENTS

| | | | |
|---|---|---|---|
| 763,285 | 12/1956 | United Kingdom | 200/61.43 |

*Primary Examiner*—Stanley J. Witkowski
*Attorney, Agent, or Firm*—Alan H. MacPherson; Henry K. Woodward; Robert C. Colwell

[57] ABSTRACT

A new and improved case for electronic wristwatch modules, which case has an improved means for activating the watch display means. The new case of this invention comprises a frame for supporting a module containing a frequency standard, a frequency divider, an electro-optical display means, and switching means for operating the display means; at least one bar retained in an edge of the frame; means for biasing the bar away from the frame; and, means coupling the bar to the switching means, whereby pressure exerted on the bar operates the display means.

5 Claims, 4 Drawing Figures

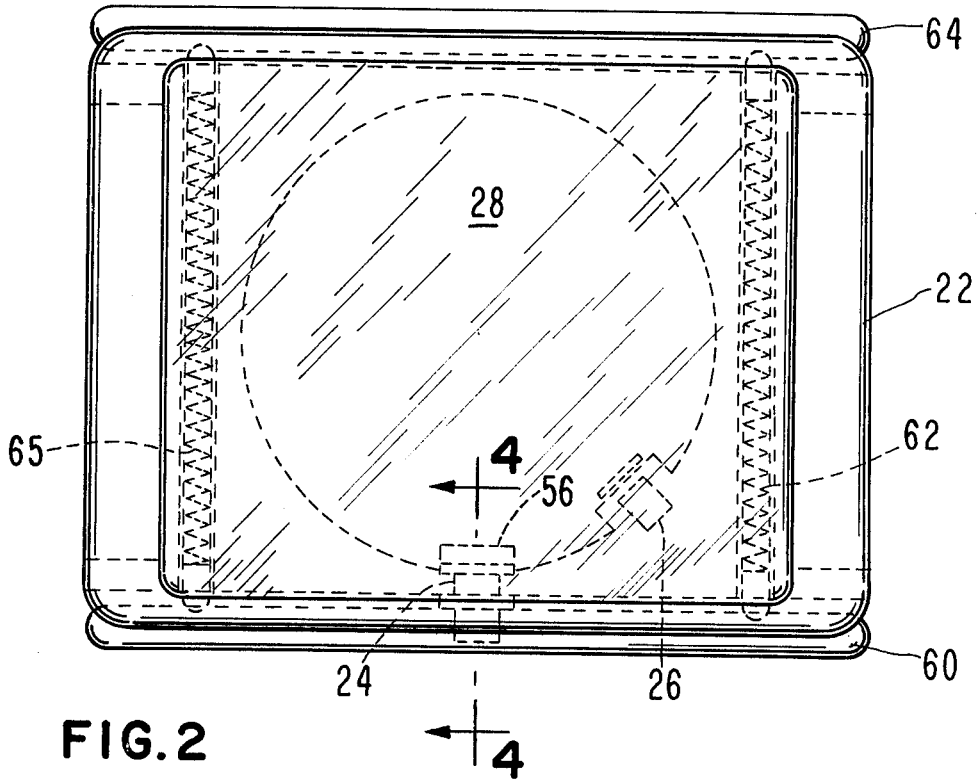
FIG. 2
FIG. 3
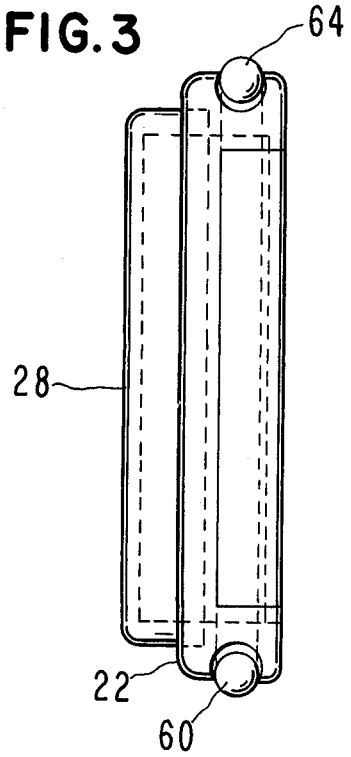
FIG. 4
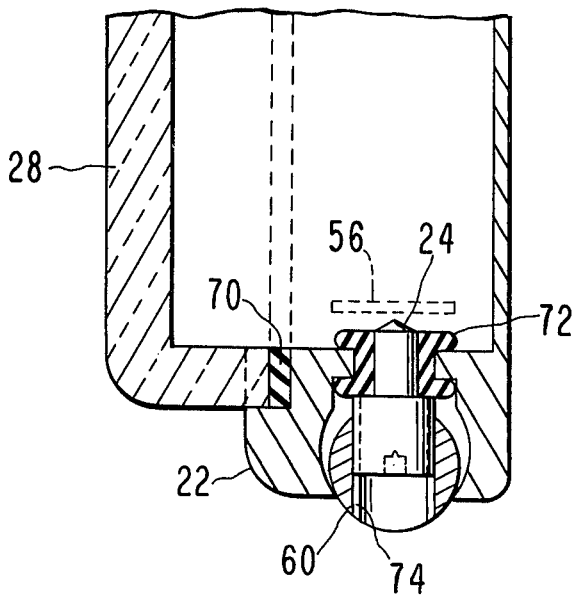

CASE FOR AN ELECTRONIC WRISTWATCH MODULE

BACKGROUND OF THE INVENTION

1. Field of the Invention

This invention generally relates to wristwatches, and in particular to a new watch case for electronic wristwatch modules.

2. Prior Art

The more recently developed electronic watches, and those employing light emitting diode (LED) displays require the wearer to depress a button to operate the display. Since the innovation of the LED electronic wristwatches, various attempts have been made to simplify the display operation, or to replace the display button with an inertia switch or the like. One such prior art device is to use a flexible retrofit member affixed to the back of the watch with an extension disposed adjacent to the display button and another extension located on the wearer's arm. The principle of operation of this device is that the wearer curls his or her wrist so that the first extension depresses the display button in response to pressure applied to the second extension. This prior art device is functional but has little aesthetic appeal for use in conjunction with jewelry. In addition, this prior art device is uncomfortable to the wearer.

Another more common type of prior art device is an inertia switch for replacement of the display button. This device activates the display of the watch by a flick of the wrist. A basic disadvantage of this prior art device is that the display is activated in response to any rapid movement of the wrist, oftentimes when the wearer does not wish to activate the display means. Thus, an active wearer of an electronic watch employing an inertia switch could discharge the batteries more rapidly than normal.

BRIEF DESCRIPTION OF THE DRAWINGS

FIG. 2 is a top plan view of the case;

FIG. 3 is an end view of the case; and,

FIG. 4 is a cross-sectional view of the case through the display switch.

SUMMARY OF THE INVENTION

Figure 1:
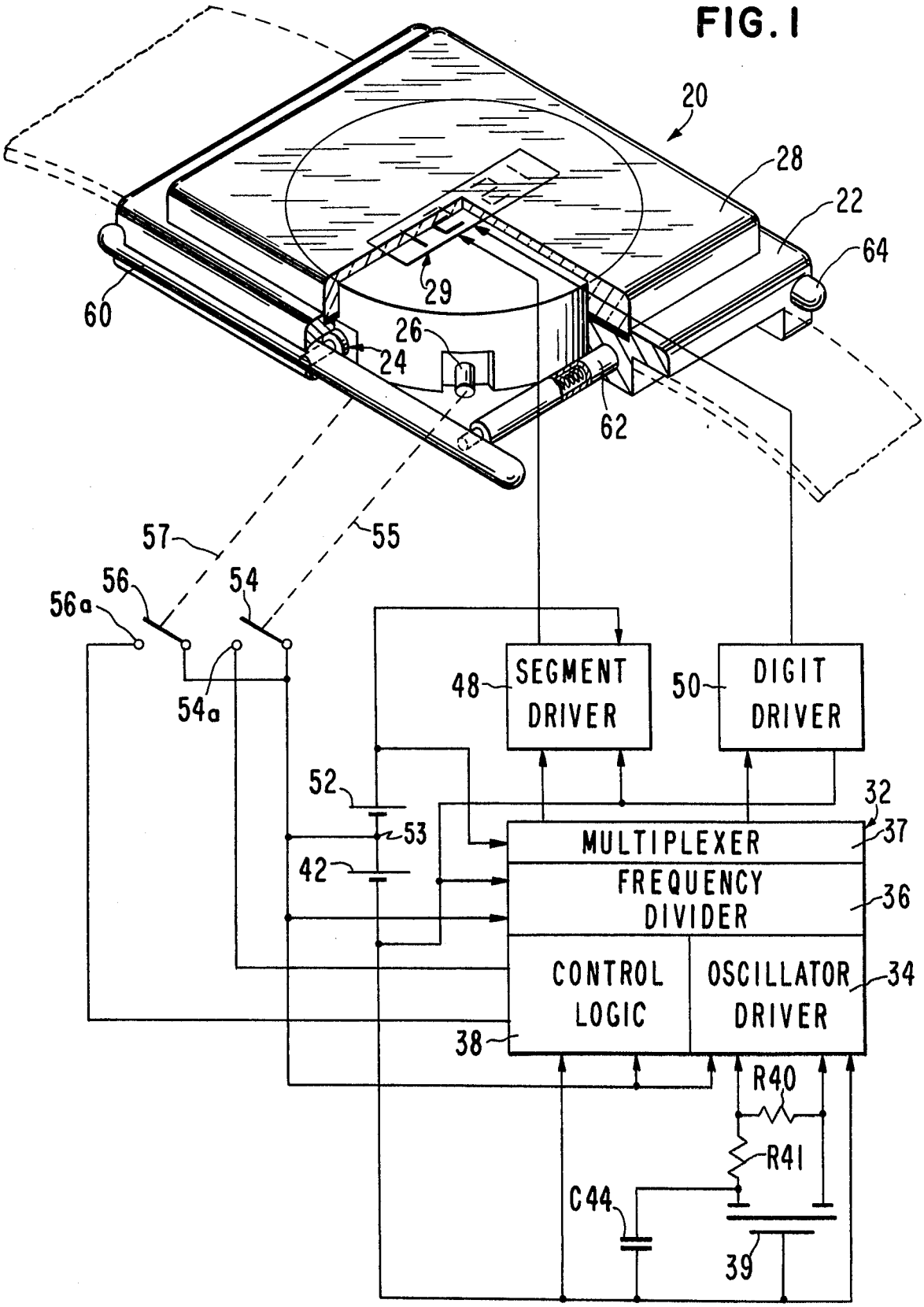
FIG. 1 is a partially cut-away perspective view of the watch case of this invention, including a block diagram of the circuitry of the watch module.

In accordance with the present invention, a case for an electronic wristwatch module is provided, which comprises a frame for supporting a module containing a frequency standard, a frequency divider, an electro-optical display means, and switching means for operating the display means; at least one bar retained in an edge of the frame; means for biasing the bar away from the frame; and, means coupling the bar to the switching means, whereby pressure exerted on the bar operates the display means.

DETAILED DESCRIPTION OF THE DRAWINGS

Like reference numerals are employed in the following description of the drawings to represent the same part or parts illustrated and described.

Referring now to the drawings, and in particular to FIG. 1, a block diagram of the digital wristwatch 20 employing the case 22 of the present invention is illustrated, which drawing includes a partial cut-away perspective view of the watch case. The wristwatch 20 includes a time display command switch button 24, and a set or reset switch button 26, which are both illustrated in the partially cut-away portion of the case 22. A display window 28 covers an electro-optical display means 29, which window is typically formed from a transparent red plastic or ruby material.

An integrated circuit chip 32 is provided, as the time generating means, which contains an oscillator driver 34, a frequency divider circuit 36 and a control logic circuit 38. The oscillator circuit generates an oscillatory signal of typically 32,768 Hz, and the frequency divider circuit 36 steps this frequency down to that representative of seconds, minutes, hours, month and day. The multiplexer 37 translates the output of the frequency divider for the display means 29. The control logic circuit 38 functions to control the operation of the frequency divider and multiplexer 37 in response to activation of switch buttons 24 and 26.

The oscillator includes components external to the integrated circuit chip (i.e., oscillator driver 34) to provide the necessary oscillatory signal. That is, a frequency standard crystal 39 is coupled across two terminals of the oscillator driver 34 to establish a fixed frequency of oscillation. A resistor R40 is coupled across the crystal 39, and the resistor R41 is coupled between one side of the crystal and the oscillator. A fixed capacitor C44 of approximately 30 picofarads is coupled between one terminal of crystal 39 and the negative terminal of a battery cell 42. The battery cell 42 typically provides 1.5 volts. Crystal 39 in this embodiment may comprise for example a tuning fork quartz crystal. Such a crystal is manufactured by the Statek Corporation of Orange, Calif.

In the embodiment illustrated and described herein, a variable capacitor is not shown as is typically used in prior art devices. In lieu of a variable capacitor, a frequency adjustment circuit may be employed in the integrated circuit chip 32 as disclosed in co-pending application Ser. No. 687,053, filed May 17, 1976, entitled "Frequency Adjustment Circuit" by D. R. Duff, et al., and assigned to the same assignee as the present invention. On the other hand, a variable capacitor could be used for frequency stabilization.

The negative terminal of battery cell 42 is also coupled to negative voltage supply input terminals of the oscillator circuit 34, the frequency divider circuit 36, and the control logic 38. In addition, the negative voltage terminal of battery cell 42 is provided at voltage supply inputs of a segment driver 48 and a digit driver 50. These latter two driver circuits have inputs coupled to outputs of the multiplexer 37, and outputs coupled to the electro-optical display means 29.

The positive terminal of the battery cell 42 is coupled to the negative terminal of a second battery cell 52 and a circuit terminal point 53, which battery cell also typically supplies 1.5 volts. The positive terminal of battery cell 52 is coupled to voltage supply input terminals of the multiplexer 37, and the segment driver 48, thereby providing three volts across these circuits. The terminal 53 between the battery cells 42 and 52 is coupled to other voltage supply input terminals of the oscillator driver 34, the control logic 38 and the frequency divider 36, thereby providing 1.5 volts across these circuits.

The terminal 53 is also coupled to the operating terminals of a pair of switches 54 and 56. The operating terminals of switches 54 and 56 are activated by the switch buttons 26 and 24, respectively, as indicated in FIG. 1 by the dash lines 55 and 57, respectively. The normally open terminals 54*a* and 56*a* of switches 54 and 56, respectively, are coupled to the control logic circuit 38 to complete current paths for these switches. A single depression of switch button 24 closes the switch 56, which causes the multiplexer 37 to drive the display means 29, thereby displaying the frequency divider status of hours and minutes for approximately 1 to 1.5 seconds in a form similar to that shown on the face of the watch 20. The display operation is effected by providing a current path to the electro-optical display means 29 through the segment driver 48 in the display means, and back to the negative terminal of cell 42 by means of the digit driver 50. For example, in a typical watch circuit design, if the switch button 24 is depressed twice in rapid succession, the control logic circuit 38 causes the multiplexer circuit 37 to multiplex a display of the current month and date. If the button 24 is depressed three times in rapid succession the control logic 38 causes a display of the seconds. The button 26 is used in conjunction with the button 24 to set the frequency divider circuit to the correct month, day, hour and minute.

In the watch case of this invention, means are provided for operating the switch 24 with ease to thereby overcome the disadvantage of the prior art electronic watch modules, which require the depression of a single button. In particular, a bar 60 is located in the edge of the case 22, which bar is mechanically coupled to the switch 24. Bar 60 is biased away from the edge of the case 22 by means of a spring 62. In the embodiment illustrated herein, a second bar 64 is located in the opposite edge of the case 22 and is biased away from the edge of the frame 22 by the same spring 62. Another spring (not shown) may also be located in the case 22 on the opposite end from that where spring 62 is located. The use of the second spring will balance the biasing of the bars 60 and 64 away from the edges of the watch case 22. However, it is pointed out that bar 64 performs no function in operating the watch of this embodiment, but merely provides a balance against the bar 60. To operate the display means 29 by the watch case of this invention, the wearer merely depresses the bar 60. Any depression anywhere along the bar 60 will operate the switch 24 thereby operating the electro-optical display means 29. It is also possible with the watch case design of this invention for the wearer to curl his or her wrist, thereby making contact with the bar 60 and thus operating the electro-optical display means. Therefore, the problem associated with the prior art electronic wristwatches requiring the wearer to depress a single button is obviated.

Referring now to FIG. 2, a plan view of the watch case 22 of the present invention is illustrated. The second spring 65, which was not shown in FIG. 1, is illustrated in a position parallel to the spring 62 and on the opposite end of the case 22. The symetry of the bars 60 and 64 and the biasing springs 62 and 65 is clearly illustrated in the plan view of FIG. 2.

FIG. 3 illustrates an end view of the watch case 22, wherein the biasing of the bars 60 and 64 away from the edges of the case 22 by means of the springs 62 and 65 is clearly illustrated.

FIG. 4 is a cross-sectional view taken along the section line 4—4 of FIG. 2. A gasket 70 is located between the case 22 and the display window 28 to seal the watch module inside the case for moisture resistance. Also, a grommet 72 is located in the watch case opening receiving the switch button 24, which grommet also seals the watch module in the case for moisture resistance.

The operating terminal 56 is illustrated by dashed lines in close proximity to an end of the switch button 24. The other end of button 24 is secured to the bar 60 by means of threads 74. Button 24 thus comprises a screw which is secured in the bar 60. Accordingly, sensitivity of switching can be adjusted by tightening or loosening button 24.

It may be appreciated from the discussion hereinabove that a new case for an electronic wristwatch module has been described in detail, which case has an improved means for activating the display of the watch. Thus, while the invention has been particularly shown and described with reference to a preferred embodiment, it will be understood by those skilled in the art that the foregoing and other changes in form and details may be made without departing from the spirit and scope of the invention. Accordingly, it is intended that the present invention only be limited by the claims set forth hereinbelow.

I claim:

1. An electronic wristwatch assembly comprising:

a case for supporting a module containing a frequency standard, a frequency divider, an electro-optical display means, and switching means for operating said display means;

an elongated member having a straight longitudinal axis retained in an edge of the case;

a second elongated member having a straight longitudinal axis retained in an opposite edge of the case from the elongated member, the axis of the second elongated member being parallel to the axis of the elongated member;

means for biasing the elongated member away from the case including at least one spring disposed perpendicular to the longitudinal axis of the elongated member, and disposed between the elongated member and the second elongated member; and means for coupling the elongated member to the switching means, whereby force exerted on said elongated member causes it to move in a direction other than that direction defined by its longitudinal axis to thereby operate the display means.

2. An electronic wristwatch assembly as in claim 1 wherein a region of the surface of the elongated member extending from one end thereof to the opposite end thereof projects beyond the surface of the case.

3. An assembly as in claim 1 wherein the means for biasing includes two springs, one disposed on each side of the midpoint of the length of the elongated member.

4. An assembly as in claim 1 wherein the means for coupling the elongated member to the switching means is adjustable to thereby allow adjustment of the sensitivity of the switching means.

5. An assembly as in claim 4 wherein the means for coupling comprises a threaded screw and threads are provided in the elongated member for receiving said threaded screw.

* * * * *